US009181652B2

(12) United States Patent
Harrison

(10) Patent No.: US 9,181,652 B2
(45) Date of Patent: Nov. 10, 2015

(54) BEDDING PRODUCT HAVING DIFFERENT COLORS FOR HEM AND BODY

(71) Applicants: Phillip Harrison, Lancaster, SC (US); Sobel Westex, Las Vegas, NV (US)

(72) Inventor: Phillip Harrison, Lancaster, SC (US)

(73) Assignees: Phillip Harrison, Lancaster, SC (US), part interest; Sobel Westex, Las Vegas, NV (US), part interest ( * ) Notice: Subject to any disclaimer, the term of this patent is extended or adjusted under 35 U.S.C. 154(b) by 127 days.

(21) Appl. No.: 13/933,694

(22) Filed: Jul. 2, 2013

(65) Prior Publication Data

US 2015/0007388 A1 Jan. 8, 2015

(51) Int. Cl.

| | |
|---|---|
| ***D06P 3/52*** | (2006.01) |
| ***D06P 5/02*** | (2006.01) |
| ***D06P 3/60*** | (2006.01) |
| ***D06P 1/02*** | (2006.01) |
| ***A47G 9/02*** | (2006.01) |
| ***D06P 3/82*** | (2006.01) |
| ***D06P 5/20*** | (2006.01) |
| ***D06L 3/02*** | (2006.01) |
| ***D06M 11/40*** | (2006.01) |
| *G09F 3/02* | (2006.01) |

(52) U.S. Cl.

CPC ... *D06P 5/02* (2013.01); *A47G 9/02* (2013.01); *A47G 9/0238* (2013.01); *A47G 9/0253* (2013.01); *A47G 9/0261* (2013.01); *D06L 3/02* (2013.01); *D06M 11/40* (2013.01); *D06P 3/6025* (2013.01); *D06P 3/8247* (2013.01); *D06P 5/2066* (2013.01); *A47G 2009/0276* (2013.01); *G09F 2003/0282* (2013.01)

(58) Field of Classification Search

CPC ..... D06P 5/02; A47G 9/02; A47G 9/0253; A47G 9/0238; A47G 9/0261

See application file for complete search history.

(56) References Cited

U.S. PATENT DOCUMENTS

| | | | | |
|---|---|---|---|---|
| 3,047,577 | A | 7/1962 | Schwechten et al. | |
| 3,576,589 | A | 4/1971 | Coon | |
| 3,617,169 | A * | 11/1971 | Schulz | 8/532 |
| 3,679,348 | A * | 7/1972 | Asahi | 8/541 |
| 3,785,766 | A | 1/1974 | Botros | |
| 4,105,403 | A * | 8/1978 | Andrews et al. | 8/115 |
| 4,214,541 | A | 7/1980 | Zeigler, Jr. et al. | |
| 4,224,883 | A | 9/1980 | Zeigler, Jr. et al. | |
| 4,425,718 | A | 1/1984 | Kawaguchi | |
| 4,624,198 | A | 11/1986 | Beam et al. | |
| 5,334,734 | A | 8/1994 | Niedenbrueck et al. | |
| 5,554,774 | A | 9/1996 | Bergmann et al. | |
| 6,190,735 | B1 | 2/2001 | Radwanski et al. | |
| 6,203,581 | B1 * | 3/2001 | Lai et al. | 8/549 |
| 6,544,300 | B1 | 4/2003 | Cliver et al. | |
| 7,235,110 | B2 | 6/2007 | Alpert | |
| 7,730,564 | B2 | 6/2010 | Moore | |
| 7,819,927 | B2 | 10/2010 | Greenspoon | |
| 8,011,038 | B2 * | 9/2011 | Balasundharam | 5/496 |
| 2006/0026731 | A1 * | 2/2006 | Qashou | 2/69 |
| 2007/0224422 | A1 | 9/2007 | Fakhreddine et al. | |
| 2011/0009021 | A1 | 1/2011 | Schoots et al. | |

* cited by examiner

*Primary Examiner* — Amina Khan

(74) *Attorney, Agent, or Firm* — Kilpatrick Townsend & Stockton LLP

(57) ABSTRACT

A bedding product having a colored hem and methods of making the same are disclosed. The bedding product can have a plain body attached to a colored hem which is made color fast so as to inhibit fading of the colored hem and/or prevent bleeding, crocking, and/or running of color from the colored hem onto the plain body during the useful life of the bedding product. The colored hem can be made color fast by a method including selecting a fabric, selecting dyes based on the fabric, preparing the fabric such as by mercerizing, applying the dyes, and treating the dyed fabric to remove unfixed dyes contained in the fabric to improve subsequent colorfastness.

12 Claims, 4 Drawing Sheets

BEDDING PRODUCT HAVING DIFFERENT COLORS FOR HEM AND BODY

BACKGROUND OF THE INVENTION

Sheets, pillowcases, and other bedding products used in the hospitality industry are changed and washed on a frequent basis due to the high volume of guests staying for short term intervals. To meet stringent hospitality standards for cleanliness, such hospitality linens are often subjected to a laundering process that is much more strenuous than the washing process used in an ordinary residential home setting. Hospitality laundering often entails much higher temperatures than residential washing and commonly employs commercial grade surfactants that are much more severe than their residential counterparts. Due to the extreme strain upon products during hospitality laundering, there is a high likelihood that the color of any colored portion of these products will fade and/or bleed onto, crock, or otherwise stain other portions of the pillowcase, sheet, or other item during use, washing, and/or drying. Accordingly, any hospitality product that includes any color must exhibit substantial color-fastness.

The term "colorfastness" is used in the textiles industry to denote the degree to which a dyed article will retain or maintain its original finished hue and resist fading or running of color over time due to washing, drying, exposure to sun or other bright light, and/or other types of wear during the useful life of the article. Factors known in the industry to affect colorfastness primarily include the types of fibers, dyes, and treatments used for initially producing an article and setting its color. However, although these factors can be identified on a general level, the details and exact modifications necessary to achieve improvements in colorfastness are infrequently so easy to articulate. As such, even though extensive testing and significant effort has been dedicated to advancing the art of colorfastness, articles with multiple colors are not known to be used in the hospitality industry at present.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Disclosed is a method of producing a bedding product including a bedding product body and a colored hem. The method can include selecting a hem fabric at least in part based upon composition of the fabric. The composition of the fabric can be selected from the group consisting of cotton-only, blends of cotton and polyester, and blends of cotton and non-cotton material. The method can also include selecting a combination of dyes at least in part based upon the composition of the fabric; if the composition contains cotton, the combination of dyes includes a first subcombination of dyes, and if the composition contains polyester, the combination of dyes includes a second subcombination of dyes. The method can also include preparing the hem fabric by mercerization if the selected fabric contains cotton. The method can also include applying the combination of dyes to the selected fabric. The method can also include passing the fabric through a multiple stage wash to substantially remove unfixed dyes from the hem fabric. The method can also include attaching a hem comprising hem fabric to the bedding product body.

Also disclosed is a bedding product having a colored hem attached to a body. The colored hem can include fabric produced according to a method. The method can include mercerizing the fabric, applying dyes to the fabric, and purging the fabric such that substantially all wash liquor is removed from the fabric.

For a fuller understanding of the nature and advantages of the present invention, reference should be made to the ensuing detailed description and accompanying drawings.

DETAILED DESCRIPTION OF THE INVENTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Disclosure herein is directed to a bedding product having a colored hem and methods of making the same. For such a bedding product to be viable for use in the hospitality industry, the product needs to exhibit substantial colorfastness over a significant number of industrial washes. While the exact number of washes may vary between hospitality providers, it is not uncommon for the target life span of a bedding product to exceed 50 industrial washes. Industrial washing includes laundry procedures established in a commercial setting established to wash products such as towels, table linens, and sheets used by providers in the hospitality industry such as nursing homes, rentals, and hospitals. Depending on the size of the facility, an industrial wash setup can involve washing several hundred pounds per shift or tens of thousands of pounds per shift. Additionally, while two different hospitality properties will likely use two slightly different settings for their industrial washes, industrial washes across the hospitality industry share a common set of parameters. For instance, industrial washing frequently involves extreme wash temperatures ranging from 40 to 160° F. (e.g., many nursing homes are known to use temperatures of 160° F. for increased sanitization of their products, while many hotels tend to wash in a more moderate temperature of around 130° F.). Additionally, industrial washing can involve surfactants as harsh as Sodium Hypochlorite with up to 0.027% available free chlorine (e.g., nursing homes frequently use significant amounts of bleach and may reach such concentrations, while hotels vary whether or not they utilize bleach during their laundering). Furthermore, industrial washing can involve a variety of PH levels, ranging from as low 5.5 as to as high as to 12.5. For example, PH commonly varies depending on the type of detergent used. Because many detergents require a PH in the 10 to 11 range, the washing process on many occasions also involves neutralizing by subsequently introducing an acid (PH of 5 to 6) to bring the PH back down to 7. As such, a product designed to withstand industrial washes (which can vary significantly between hospitality providers) is designed to withstand washes that include just one, multiple, or all of these parameters. Regardless, bedding products in accordance with embodiments as described further herein exhibit colorfastness when subjected even to 50 industrial washes.

Figure 1:
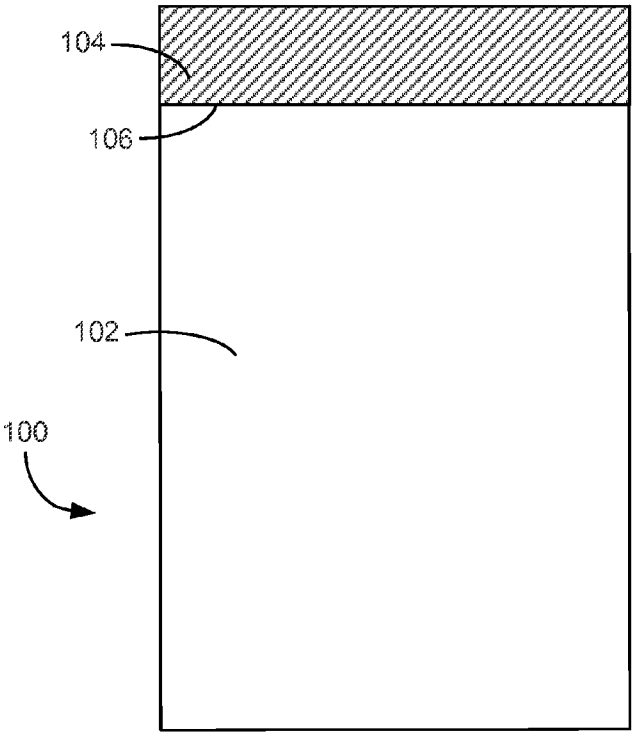
FIG. 1 is a top perspective view of a bedding product with a colored hem in accordance with embodiments.

Referring now to the drawings, in which like reference numerals represent like parts throughout the several views, FIG. 1 shows a top perspective view of a bedding product 100 with a colored cuff or hem (hereinafter colored hem) 104 in accordance with embodiments. The bedding product 100 can have a plain body 102 attached to a colored hem 104. Although described as having a plain body 102 and a colored hem 104, embodiments herein are directed to a hem and a body that are connected together and of different colors, wherein one of the colors may bleed on the other. Additionally, "plain" refers to an undyed fabric, but embodiments alternatively can include a body that is dyed a different color from the hem. In embodiments, the colored hem 104 is made color fast so as to inhibit fading of the colored hem 104 and/or prevent bleeding, crocking, and/or running of color from the colored hem 104 onto the plain body 102 during the useful life of the bedding product 100. The colored hem 104 can be made color fast by a method which will be explained in more detail with reference to FIG. 2. In various embodiments, the colored hem 104 is attached to the plain body 102 by stitching 106. The stitching 106 can be of any style and use any type of thread, and the stitching 106 is not limited solely to the examples described later herein. The bedding product 100 is not limited to the relative dimensions shown in FIG. 1, and the bedding product 100 may be any type or size of bedding product, such as a pillow case, a sheet, a bedspread, comforter cover, or any other bedding product.

As will be appreciated by one skilled in the art, a number of factors must be taken into consideration when fabricating textiles. Variations in the fabric—including, but not limited to, composition, weight, or size—may necessitate requisite adjustments in various variables—including, but not limited to, times, temperatures, or concentrations—in order to achieve comparable results. To accommodate such variations and adjustments, mainly general terms are used in initial descriptions herein, and a number of exemplary results are subsequently described in more detail in an "Examples" section.

Figure 2:
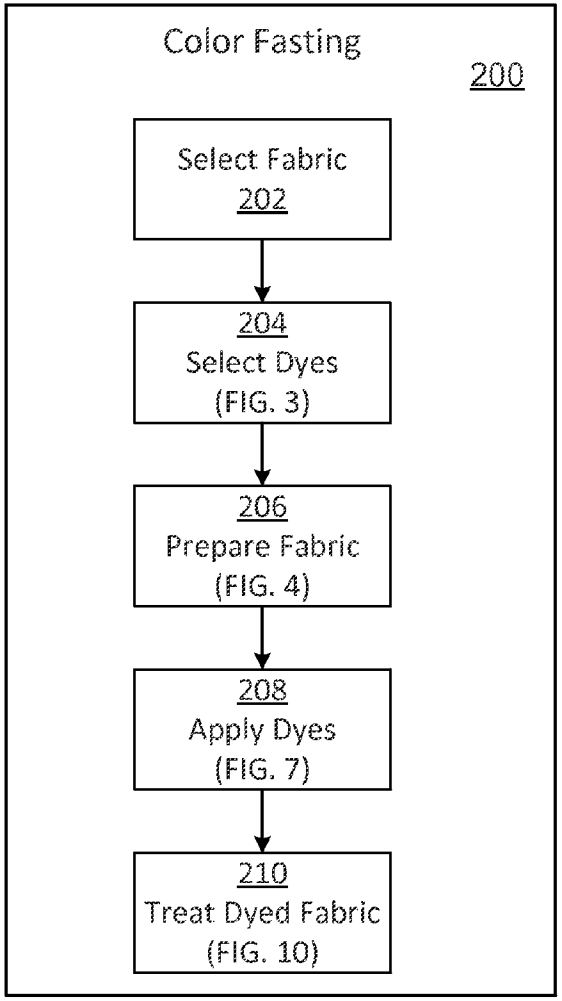
FIG. 2 is a flowchart representing a method of making an article of fabric colorfast in accordance with embodiments.
Figure 4:
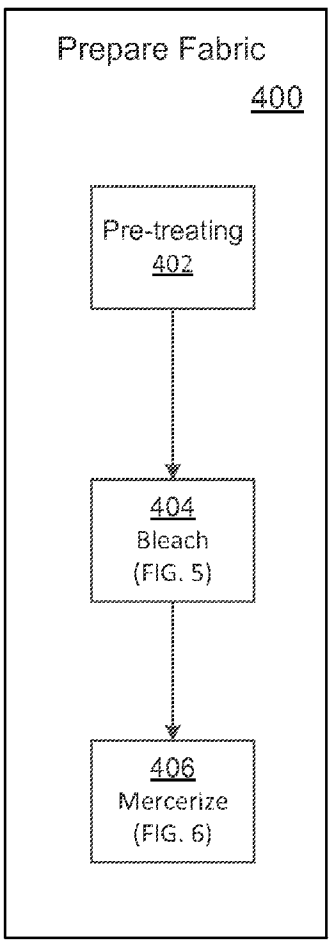
FIG. 4 is a flowchart representing a fabric preparation method in accordance with embodiments.
Figure 3:
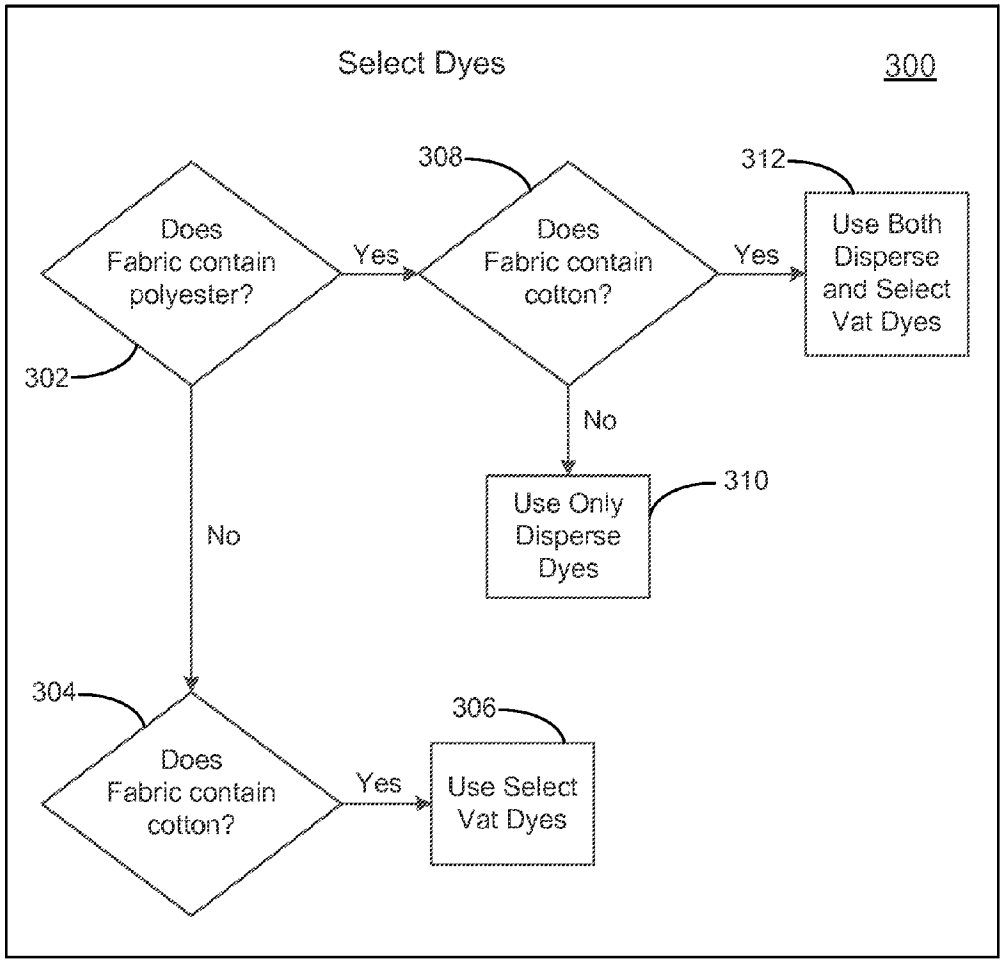
FIG. 3 is a flowchart representing a dye selection method in accordance with embodiments.
Figure 7:
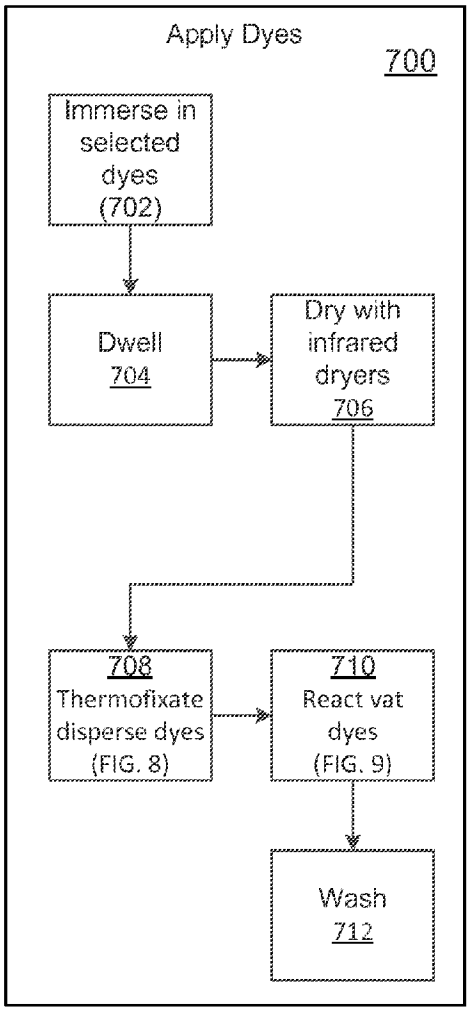
FIG. 7 is a flowchart representing a dye application method in accordance with embodiments.
Figure 10:
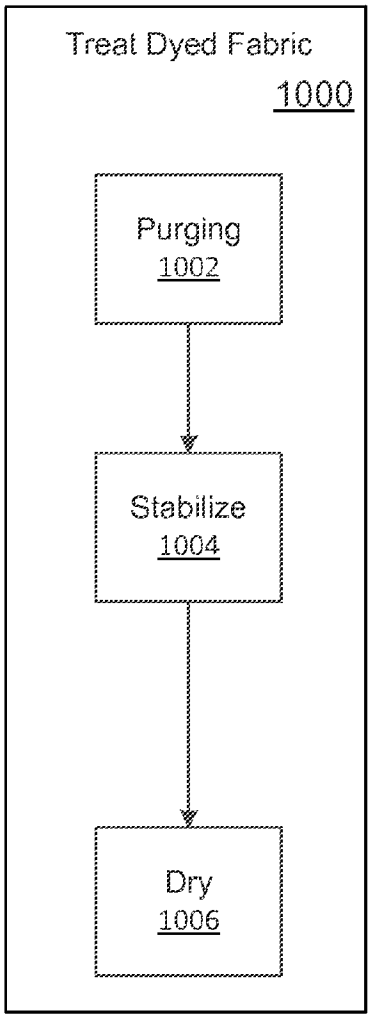
FIG. 10 is a flowchart representing a dyed fabric treatment method in accordance with embodiments.

FIG. 2 is a flowchart representing a method 200 of making an article of fabric colorfast in accordance with embodiments. A color fasting method 200 can include a number of subparts, which may be included, omitted, or varied according to a specific embodiment. Each subpart can affect how colorfast the finished product will be. In various embodiments, the color fasting method 200 can include selecting a fabric 202. In selecting a fabric 202, a fabric can be selected having a composition with certain inherent properties that will affect how colorfast the finished product can be. The color fasting method 200 can also include selecting dyes 204. In selecting dyes 204, a combination of dyes can be selected based at least in part on the composition of the fabric selected when selecting a fabric 202. The color fasting method 200 can furthermore include preparing the fabric 206. In preparing the fabric 206, the selected fabric can be prepared so that the fabric can better absorb and/or retain the selected dyes. Additionally, the color fasting method 200 can include applying the dyes 208. In applying the dyes 208, dyes are applied to the selected or prepared fabric so as to penetrate the dyes into the fabric. Moreover, the color fasting method 200 can include treating the dyed fabric 210. In treating the dyed fabric 201, the dyed fabric is treated so as to remove unfixed dyes contained in the fabric to improve subsequent colorfastness. As shown in FIG. 2, in some embodiments, the subparts include methods illustrated in further figures (e.g., selecting dyes 204 as shown in FIG. 3, preparing the fabric 206 as shown in FIG. 4, applying the dyes 208 as shown in FIG. 7, and/or treating the dyed fabric 210 as shown in FIG. 10), though the subparts can also vary from the descriptions associated with the various referenced figures.

Selecting the fabric 202 can involve selecting a fabric based at least in part upon the fabric's composition. Cotton is a popular material for bedding products in the hospitality industry, and in embodiments, the selected fabric comprises cotton. Furthermore, polyester is a material commonly combined with cotton to modify the final qualities (e.g., strength) of fabrics used in the hospitality industry, and in various embodiments the fabric selected is a blend of cotton and polyester (also referred to as a cotton-poly blend). However, compositions are not limited to cotton and cotton-poly blends, and it is contemplated that the fabric could also be selected from a blend of cotton and non-cotton material.

Selecting dyes 204 during the color fasting method 200 can involve a dye selection method 300. FIG. 3 is a flowchart representing a dye selection method 300 in accordance with embodiments. Dye selection method 300 begins with a first query 302 of whether the selected fabric contains polyester. If the selected fabric does not contain polyester (i.e., the answer is "No" to the first query 302), the selection method 300 proceeds to a second query 304 of whether the selected fabric contains cotton material. If the selected fabric contains cotton (i.e., the answer is "Yes" to the second query 302), the selection method 300 terminates with the conclusion 306 that select vat dyes are to be used. If, however, the selected fabric does contain polyester (i.e., the answer is "Yes" to the first query 302), the selection method 300 proceeds to a third query 308 of whether the selected fabric contains cotton material. If the selected fabric contains polyester but no cotton (i.e., the answer is "No" to the third query 308), the selection method 300 terminates with the conclusion 310 that only disperse dyes are to be used. If, however, the selected fabric contains both polyester and cotton (i.e., the answer is "Yes" to the third query 308), the selection method 300 terminates with the conclusion 312 that both disperse dyes and select vat dyes are to be used.

The terms "vat dyes" and "disperse dyes" are well known in the art of dyeing textiles. As used herein, the term "select vat dyes" refers to the group of vat dyes consisting essentially of violanthrones, anthraquinone, anthraquinone carbazoles, and indanthrones. Furthermore, in many embodiments, dyes used when polyester is present in the fabric include high-energy disperse thermofixation dyes.

Preparing the fabric 206 during the color fasting method 200 can involve a fabric preparation method 400. FIG. 4 is a flowchart representing a fabric preparation method 400 in accordance with embodiments. The fabric preparation method 400 can include one or more of pre-treatment 402, bleaching 404, and mercerizing 406.

In embodiments, pre-treatment 402 can be utilized to counteract effects resulting from the initial production of the fabric. In embodiments, pre-treatment can include one or both of singeing and desizing.

Singeing can involve exposing the fabric to at least one flame. Often hairy or extruding fibers result from a fabric production process, such as where fibers are spun together to make threads. In the process, many fibers end up not fully aligned in the thread direction, and the parts of these misaligned fibers that stick out from the thread give the thread a hairy appearance. During singeing, the face and/or the back of the fabric can be singed so as to burn these extruding fibers extending from the fabric and so reduce the number of them. Accordingly, singeing can remove extraneous fibers to improve the texture and characteristics of the fabric in various embodiments.

Desizing can involve removing a sizing agent used during the fabric production process. In many fabric production processes, fibers, yarns, or threads are coated with a sizing agent (such as starch or PVA—Polyvinyl alcohol) to improve the strength of the components while being combined into fabric. However, this coating can interfere with penetration of dyes into the fibers when applying dyes. Accordingly, in embodiments, desizing involves passing the fabric through a quench bath comprising a desizing agent to remove a residual amount of a sizing agent remaining on the fabric from production of the fabric. The desizing agent generally depends upon the sizing agent. For example, to remove starch as a sizing agent, the fabric can be immersed into enzymes and allowed to sit for a sufficient amount of time (e.g., 12 hours) to allow the enzyme to break down the starch so that it can be removed with hot water. In contrast, PVA can be removed merely by the application of hot water. In some embodiments, pre-treatment 402 includes a singe portion immediately followed by a desizing quench bath which also acts to extinguish any smoldering fibers from the singe portion.

Figure 5:
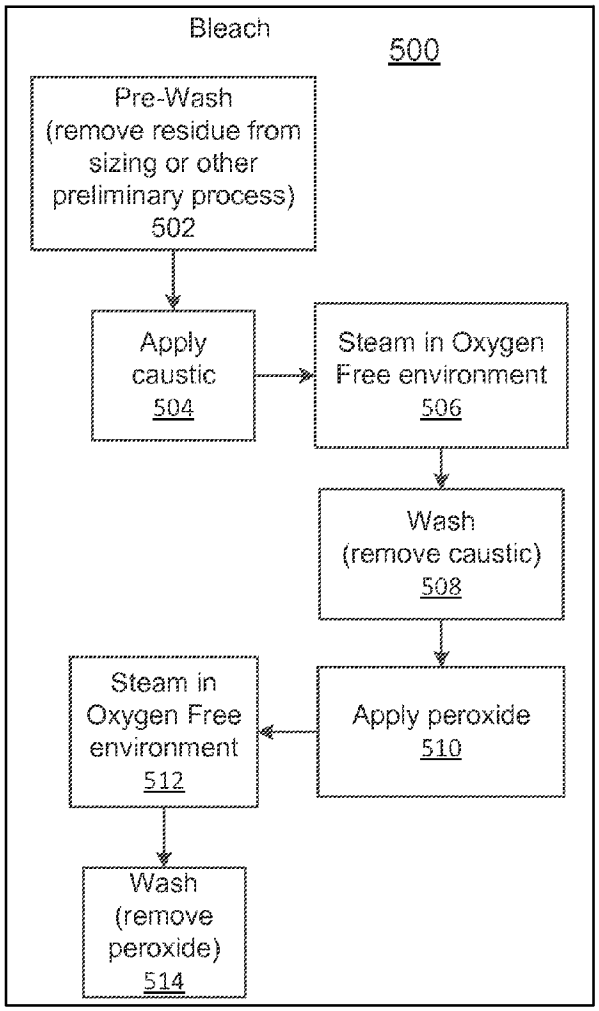
FIG. 5 is a flowchart representing a fabric bleaching method in accordance with embodiments.

Bleaching 404 during the fabric preparation method 400 can involve a fabric bleaching method 500. FIG. 5 is a flowchart representing a fabric bleaching method 500 in accordance with embodiments. The fabric bleaching method 500 can begin with a pre-wash process 502. A pre-wash process 502 can involve washing the fabric so as to remove residue from sizing, desizing, or any other preliminary process. The pre-wash process 502 can also advantageously remove additional substances—such as waxes, oil, and seed trash—that can interfere with the dyeing process. In some embodiments, pre-washing 502 acts as the final step of desizing, and hot water is provided during pre-washing 502 to remove either PVA or starch that has been broken down by enzymes. In some embodiments, pre-treating 402 does not include rinsing with hot water because pre-washing 502 during fabric bleaching method 500 provides a hot water wash. The fabric bleaching method 500 can also include applying caustic 504. Applying caustic 504 can involve saturating the fabric in the caustic by running the fabric through a bath or pad containing the caustic. The fabric bleaching method 500 can also involve allowing the fabric soaked or saturated with caustic to steam in an oxygen free environment 506. The caustic-saturated fabric can be steamed in an oxygen free environment 506 for 30 to 45 minutes depending upon the weight of the fabric. The fabric bleaching method 500 can also include an intermediary wash 508 to rinse off or neutralize the caustic carried in the fabric. The fabric bleaching method 500 can also include applying peroxide 510. Applying peroxide 510 may involve saturating the fabric in the peroxide by running the fabric through a bath or pad containing the peroxide. The fabric bleaching method 500 can also involve allowing the fabric soaked or saturated with peroxide to steam in an oxygen free environment 512. The peroxide-saturated fabric can be steamed in an oxygen free environment 512 for 30 to 45 minutes depending upon the weight of the fabric. The fabric bleaching method 500 can also include a post-wash 514 to rinse off or neutralize the peroxide carried in the fabric.

Figure 6:
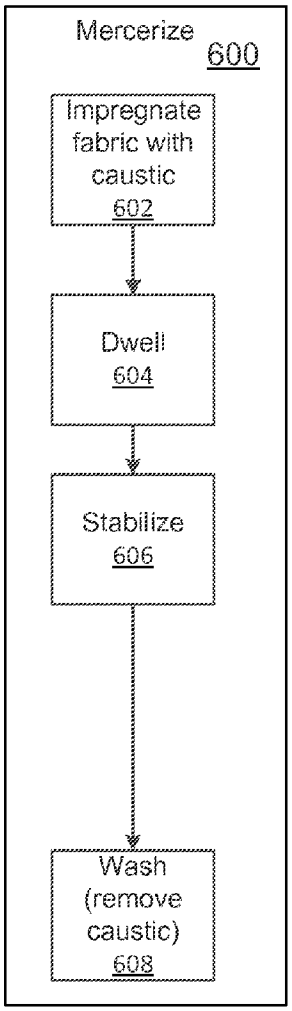
FIG. 6 is a flowchart representing a fabric mercerization method in accordance with embodiments.

Mercerizing 406 can be utilized to alter the chemical structure of fibers (especially cotton) to improve their ability to absorb dye. Mercerizing 406 during the fabric preparation method 400 can involve a fabric mercerization method 600. FIG. 6 is a flowchart representing a fabric mercerization method 600 in accordance with embodiments. The fabric mercerization method 600 can include impregnating the fabric with caustic 602. Impregnating can involve running the fabric through a bath or pad containing the caustic; in various embodiments, impregnating also involves running the fabric through a series of squeeze or nip rollers to force the caustic solution through the fabric several times. The caustic used may be sodium hydroxide. The sodium hydroxide can be in a solution having a concentration of sodium hydroxide in the 20-24% range. The sodium hydroxide can be hot, so as to avoid the caustic becoming very thick at ambient temperatures. In some embodiments, the caustic is heated in approximately the 140° F. range. After impregnating the fabric with caustic 602, the caustic can be allowed to dwell 604 in the fabric for a set time. The time that the fabric is allowed to dwell 604 can be based at least in part on the weight of the fabric. The dwell 604 can be accomplished for a set time by passing the fabric impregnated with the caustic over a set of rollers. The fabric mercerization method 600 can also include stabilizing 606. Stabilizing 606 can be accomplished by applying a chain stenter to the fabric. The stenter can pull the fabric in a width-wise direction to counteract shrinking occurring due to the chemical reaction between the caustic and the fibers. In some embodiments, the stabilizing 606 makes up part of the dwell 604 time. The fabric mercerization method 600 can also include washing 608. The washing 608 can remove at least a portion of the caustic impregnated in the fabric.

Applying the dyes 208 during the color fasting method 200 can involve a dye application method 700. FIG. 7 is a flowchart representing a dye application method 700 in accordance with embodiments. The dye application method 700 during the color fasting method 200 can involve immersing 702 the fabric into a dye bath or pad. The dye bath or pad can contain dyes selected during dye selection 204 and/or by dye selection method 300. In various embodiments, the fabric upon exiting the bath or pad is passed through at least one pair of squeeze or nip rollers so as to improve penetration of the dyes into the fabric. After immersing the fabric in the selected dyes 702, the fabric carrying the dyes can be allowed to dwell 704 for a set time. The time that the fabric is allowed to dwell 704 can be based at least in part on the weight of the fabric. The dwell 704 can be accomplished for a set time by passing the fabric carrying the selected dyes over a set of rollers. In various embodiments, the fabric is dried with infrared dryers 706. Infrared drying can advantageously set the dyes in place and prevent migration of the dyes during subsequent treatment. In embodiments, if the selected dyes include disperse dyes, the dye application method 700 can include thermofixating the disperse dyes 708. In embodiments, when the selected dyes include select vat dyes, the dye application method 700 includes reacting the select vat dyes 710. The dye application method 700 can be completed by wash 712 of the fabric. The wash 712 can advantageously remove persisting trace amounts of solutions used during thermofixating disperse dyes 708, reacting select vat dyes 710, or other earlier processing of the fabric.

Figure 8:
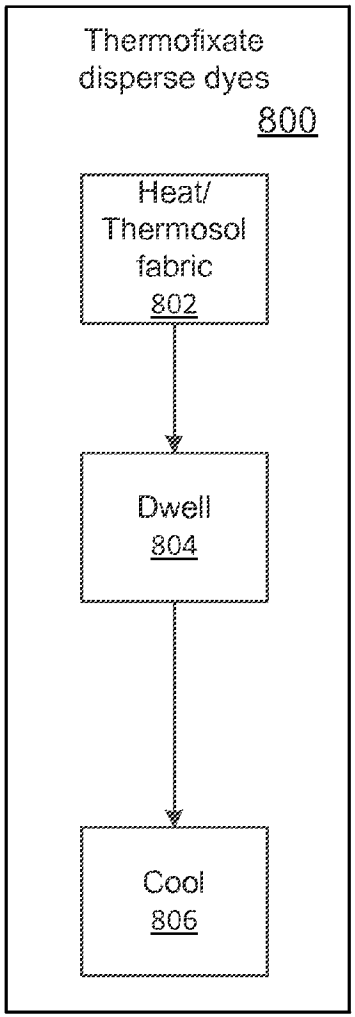
FIG. 8 is a flowchart representing a disperse dye thermofixation method in accordance with embodiments.

Thermofixating disperse dyes 708 during the dye application method 700 can involve a disperse dye thermofixation method 800. FIG. 8 is a flowchart representing a disperse dye thermofixation method 800 in accordance with embodiments. The disperse dye thermofixation method 800 can include heating and/or thermosoling 802 the fabric containing the disperse dyes. The fabric can be passed through an oven where the temperature is maintained within a certain range. In various embodiments, the thermosol oven is heated in the 390 to 420° F. range. The fabric containing the disperse dyes can be retained in the oven to achieve a certain length of time of dwelling 804. In embodiments, dwelling 804 time is provided in sufficient quantity so as to allow complete penetration and/or sublimation of the disperse dyes into polyester fibers in the fabric. Such complete penetration can advantageously prevent ring dyeing or surface dyeing, wherein the disperse dyes fail to penetrate significantly beyond the surface of the polyester fibers and become prone to frosting or high point abrasion, i.e., wearing off of the surface of the fabric through the laundering process and normal use. The dwelling 804 time provided in the thermosol oven can depend upon the weight of the fabric. In some embodiments, upon completion of dwelling 804, the fabric is allowed to cool 806. Cooling 806 can advantageously lock the disperse dye particles into the polyester fibers in the fabric and thereby diminish the risk that such color particles will be flushed out of the fabric during subsequent washing or laundering.

Figure 9:
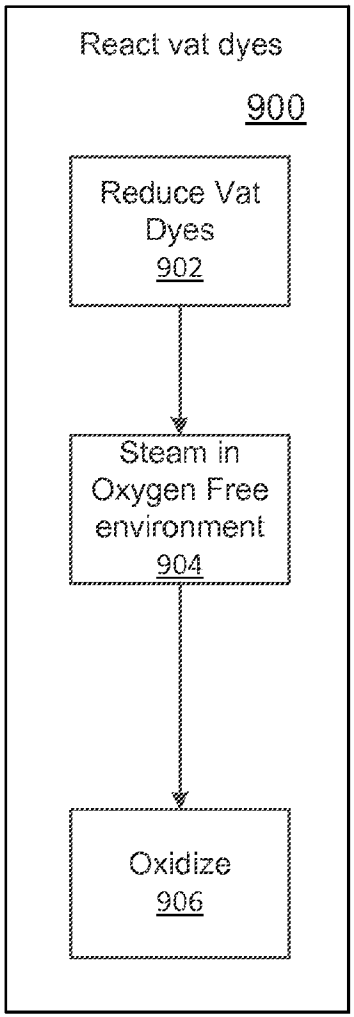
FIG. 9 is a flowchart representing a select vat dye reaction method in accordance with embodiments.

Reacting select vat dyes 710 during the dye application method 700 can involve a select vat dye reaction method 900. FIG. 9 is a flowchart representing a select vat dye reaction method 900 in accordance with embodiments. The select vat dye reaction method 900 can include reducing select vat dyes 902. Reducing select vat dyes can involve introducing the fabric into a bath or pad containing a strong alkali solution. This alkali solution can advantageously react with the select vat dyes in order to reduce the select vat dyes to a soluble state, which in turn can make the dyes more absorbable into fibers in the fabric, particularly any cotton fibers. The strong alkali solution can include sodium hydro sulphite, and in some embodiments the concentration of sodium hydro sulphite ranges between 3.0 and 5.0 g/L. The strong alkali solution can include sodium hydroxide, and in some embodiments the concentration of sodium hydroxide ranges between 3.6 and 8.8 g/L. The select vat dye reaction method 900 can include allowing the fabric carrying the reduced vat dyes to dwell for a significant time in a steamed oxygen free environment 904. Dwelling the fabric containing the reduced select vat dyes in a steamed oxygen free environment can advantageously allow greater dye penetration by the select vat dyes into the cotton fibers in the fabric. The select vat dye reaction method 900 can also include oxidizing select vat dyes 906. Oxidizing select vat dyes 906 can involve washing the fabric in an oxidizer. The oxidizer can be peroxide. Washing the fabric in peroxide can advantageously induce a chemical reaction with the select vat dyes such that the vat dyes are returned to an insoluble state, making unfixed dyes easier to remove from the fabric. In some embodiments, oxidizing 906 is performed as part of the wash 712 that completes the dye application method 700; however, oxidizing 906 and washing 712 can also be performed distinctly from one another.

Treating the dyed fabric 210 during the color fasting method 200 can involve a dyed fabric treatment method 1000. FIG. 10 is a flowchart representing a dyed fabric treatment method in accordance with embodiments. The dyed fabric treatment method 1000 can include a purging 1002. The purging 1002 can be effective to remove all or substantially all unfixed color carried in the fabric. Purging 1002 may be accomplished by passing the fabric through a series of washers, each of which removes a significant amount of the wash liquor carried into the washer in the fabric. In this manner, successive washers can successively reduce the amount of unfixed color or the amount of wash liquor carried in the fabric. In some embodiments, over 99% or more of the wash liquor is removed from the fabric during purging 1002. For example, at least seven washer boxes can be used, each of which is capable of exchanging 50 percent to 80 percent of an amount of wash liquor entering the washer box via the fabric. If such washer boxes are operated to exchange 50 percent each, the amount of wash liquor remaining in the fabric after purging 1002 will be 0.75 percent of the starting value; if such washer boxes are operated to exchange 80 percent each, the amount of wash liquor remaining in the fabric after purging 1002 will be 0.00128 percent of the starting value. While a purging 1002 utilizing seven washers is described as an example, in various embodiments, a different number of washers can be used instead. In some embodiments, surfactants are introduced in one or more of the washers. In some embodiments, surfactants are only used in the first washer in the series.

Dyed fabric treatment method 1000 can include stabilizing 1004. The stabilizing 1004 may be accomplished by applying a chain stenter to the dyed fabric. The stenter can pull the fabric in a width-wise direction to counteract any shrinking occurring during prior processing of the fabric. In various embodiments, the fabric is passed through a bath or pad with fabric softeners before entering the stenter. Use of such softeners can advantageously allow the stenter to stretch the fabric to a greater degree and accordingly counteract shrinking more effectively. The dyed fabric treatment method 1000 can also include drying 1006. In some embodiments, the stabilizing 1004 provides part of a time utilized for drying 1006. While part or all of the fabric drying 106 can occur while the fabric is passing through the stenter, in some embodiments, dryer cans are used as a supplement or substitution for drying 1006 the dyed fabric.

Drying cans can also or alternatively be used for optional drying at several different junctures during a color fasting method 200. For example, after washing 712 to complete the dye application method 700, the fabric may be dried before beginning a purging 1002 or a dyed fabric treatment method 1000. Drying can be a convenient expedient when subsequent pieces of machinery require additional preparation before use. However, on the other hand, relaying the fabric to subsequent pieces of machinery while the fabric is still wet can advantageously reduce energy costs associated with drying.

Figure 11:
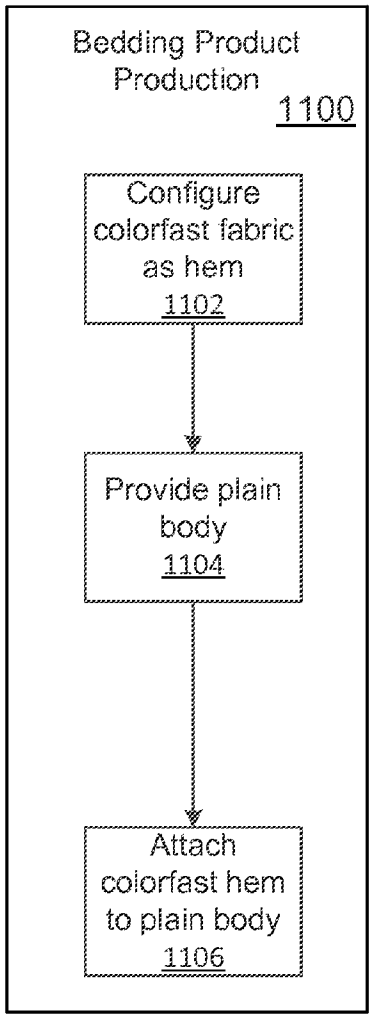
FIG. 11 is a flowchart representing a bedding product production method in accordance with embodiments.

Referring to FIG. 11, in embodiments, a colorfast bedding product can be produced according to a bedding product production method 1100. The bedding product production method 1100 can involve configuring a colorfast fabric as a hem 1102. The colorfast fabric can be produced, for example, by a color fasting method 200. The bedding product production method 1100 can also involve providing a plain body 1104 for the bedding product. The bedding product production method 1100 can also involve attachment of the colorfast hem to the provided plain body 1106. Attachment of the colorfast hem to a plain body 1106 can be performed by stitching. Accordingly, referring to FIGS. 1, 2, and 11, in embodiments, a bedding product production method 1100 may be performed such that a fabric can be made colorfast according to a method 200 and fashioned into a hem 104 for attachment to a plain body 102 by stitching 106 for the production of a bedding product 100. In some embodiments, the stitching 106 is single needle stitching comprising a minimum 30 count 2 ply 100% polyester disperse-dyed sewing thread. Such stitching can advantageously provide an attachment that is sufficiently strong and colorfast to withstand industrial washing commensurate with the expected life of other portions of the bedding product 100.

Examples

Without further elaboration, it is believed that the skilled artisan can, using the description herein, make and use colorfast bedding products 100 in accordance with this disclosure. The following examples are included to provide additional guidance to those skilled in the art. These examples are provided as representative of the work and contribute to the teaching of the present disclosure. Accordingly, these examples are not intended to limit the scope of the present invention in any way.

Representative samples described herein were produced in accordance with the following exemplary embodiment of color fasting method 200. The representative samples were produced using a common combination of machinery, which will be described first with reference to methods and figures already described herein, followed by a presentation of test results demonstrating the properties of the representative samples. For the sake of brevity and meaningful comparison, discussion of the representative samples will be limited to 5 specific samples, each sample having a different color: Tan, Blue, Yellow, Orange, and Green.

In the exemplary execution of fabric selection 202, fabric having a composition of 60% cotton/40% polyester and a weight of approximately 3.75 oz. per square yard was selected. (Although embodiments need not be limited to this particular fabric, this fabric serves as an appropriate sample for bedding products since compositions having a cotton/polyester blend up to 40% polyester are common for bedding products and weights typically range from 3.0 to 4.5 oz. per square yard.) Based on this selected composition, exemplary execution of dye selection method 300 resulted in the conclusion 312 to use both disperse and select vat dyes in the final combination of dyes. Each of the five colors was composed from a combination of three disperse dyes and three select vat dyes. The combination of three select vat dyes used and the three select disperse dyes used in each colored sample is as follows:

| Sample Color | Dyes Used: Color Name (C.I. No.) [Type of Dye]{Amount in g/L} |
|---|---|
| Tan | Yellow GCN (Yellow 2)-[Anthraquinone] {0.1279} |
| | Red FBB [Indanthrone Anthraquinone] {0.0464} |
| | Brown C-BR [Anthraquinone Carbazoles] {0.2509} |
| | Dianix Yellow C-56 [High Energy] {0.0241 g/L} |
| | Dianix Red CC [High Energy] {0.0012 g/L} |
| | Dianix Blue CC [High Energy] {0.0001 g/L} |
| Blue | Red FBB [Indanthrone Anthraquinone] {0.0114} |
| | Blue C-RS (Blue 4) [Indanthrone anthraquinone] {0.5691} |
| | Black DB [Anthraquinone Carbazoles] {0.001} |
| | Dianix Blue CC [High Energy] {0.421 g/L} |
| | Dianix Yellow C-5G [High Energy] {0.0003 g/L} |
| | Dianix Red CC[High Energy] {0.0018 g/L} |
| Yellow | Yellow 5GF [Anthraquinone] {0.4695} |
| | Red FBB [Indanthrone Anthraquinone] {0.044} |
| | Blue C-RS (Blue 4) [Indanthrone anthraquinone] {0.0108} |
| | Dianix Yellow C-56 [High Energy] {0.0328 g/L} |
| | Dianix Red CC [High Energy] {0.0016 g/L} |
| | Dianix Turqoise S-BG [High Energy] {0.0001 g/L} |

-continued

| Sample Color | Dyes Used: Color Name (C.I. No.) [Type of Dye]{Amount in g/L} |
|---|---|
| Orange | Yellow 5GF [Anthraquinone] {0.1463} |
| | Red FBB [Indanthrone Anthraquinone] {0.154} |
| | Blue C-RS (Blue 4) [Indanthrone anthraquinone] {0.1058} |
| | Dianix Yellow C-56 [High Energy] {0.0119 g/L} |
| | Dianix Red CC [High Energy] {0.0036 g/L} |
| | Sentacron Royal Blue FBL [High Energy] {0.0026 g/L} |
| Green | Yellow 5GF [Anthraquinone] {0.2336} |
| | Jade Green FB [Violanthrone] {0.0591} |
| | Brown BR (Brown 1) [Anthraquinone Carbazoles] {0.0342} |
| | Dianix Yellow C-56 [High Energy] {0.0361 g/L} |
| | Dianix Red CC [High Energy] {0.0003 g/L} |
| | Dianix Turqoise S-BG [High Energy] {0.0024 g/L} |

In the exemplary execution of fabric preparation 206, the representative samples underwent pre-treatment 402 via a combined singeing and desizing machine fabricated under the trade name Osthoff. A flame in the machine singed the fabric of the representative samples on the face and back to remove hairy or extruding fibers, and the fabric immediately afterward passed through a quench bath to extinguish any smoldering fibers and to apply an enzyme to loosen and eat away starch remaining from manufacture of the fabric. The fabric was allowed to sit for 12 hours to allow the enzyme to break down the starch so that it could be removed with hot water.

Next, exemplary execution of bleaching 404 was achieved by an open-width bleach range fabricated under the trade name Benninger. The wash boxes in the first section of the open width bleach range provided hot water to wash off the starch broken down by enzymes in accordance with pre-wash 502. Subsequent portions of the open-width bleach range subjected the representative samples to additional steps in bleaching method 500, including saturating with caustic and steaming in an oxygen free environment for 30 to 45 minutes (504 and 506), washing to neutralize caustic from the fabric (508), saturating with peroxide and steaming in an oxygen free environment for 30 to 45 minutes (510 and 512), and washing to neutralize peroxide from the fabric (514).

Subsequently, exemplary execution of mercerizing 406 was performed according to mercerizing method 600 using a mercerizing line fabricated under the trade name Benniger-Dimensa. A Benniger-Dimensa roller impregnation section introduced hot caustic (sodium hydroxide in the 20-24% range, heated in the 140° F. range to allay thickness occurring at ambient temperatures) to the representative samples and provided adequate dwell time (602 and 604). A Benniger-Dimensa chain stenter was also used for stabilization (606) to stretch the sheeting to recover some of the width lost during impregnation and dwell time, followed by a Benniger-Dimensa washer/neutralizer to remove the caustic (608).

In the exemplary execution of dye application method 700, representative samples were then immersed (702) in a dye bath—containing disperse dyes and the select vat dyes listed above with respect to each color—using a Benniger-Kuster dye pad, which includes multi-rollers in the dye bath trough and S-roll technology upon exit of the dye bath trough. The representative samples were allowed to dwell (704) using a section of rollers outside of the dye bath and then dried (706) using infrared dryers to prevent migrations of both disperse and vat dyes. Thermofixation (708) of disperse dyes was accomplished by heating (802) the representative samples in a thermosol oven operated in the 390 to 420° F. range and allowing the representative samples to dwell (804) in said oven for a time—sufficient to allow complete penetration or sublimation of the disperse dyes into the polyester in the samples to prevent ring or surface dyeing—before cooling (806) to lock the disperse dye particles into the polyester yarns. Reacting the select vat dyes (900) for the representative samples was accomplished using a Benniger-Reacta Booster Pad with strong alkali solution (i.e., including sodium hydro sulphite in the 3.0 to 5.0 g/L range and sodium hydroxide in the 3.6 to 8.8 g/L range) to reduce (902) the select vat dyes to soluble state, followed with significant dwell time steaming (904) in an oxygen-free environment in a Benniger-Reacta Reactive Steamer, and oxidizing (906) the representative samples using peroxide in a line of seven Benniger-Extracta extractors to make the selected vat dyes insoluble again.

In the exemplary execution of treating the dyed fabric 201, the dyed fabric treatment method 1000 started with a purging 1002. In the exemplary execution of the purging 1002, the representative samples were passed through a wide-width, open, continuous line of seven Benniger-Extracta high-efficiency, high-temperature, high-flow, double-laced, counter-flowing, commercial, independent washer extractors with nip rolls. Each washer extractor was adjustable for water flow, surfactants, ph, and temperature, and a surfactant was used in the first of the seven washers. Each of the washer extractors was also capable of removing or exchanging 50-80% of the wash liquor carried by the representative samples upon entry into that particular washer extractor.

In the exemplary execution of stabilization 1004, the representative samples were introduced into an immersion pad containing fabric softeners and attached to a Benniger-Dimensa chain stenter to be stretched to counteract prior shrinkage occurring during prior processing of the samples. In the exemplary execution of drying 1006, dryer cans were also used to supplement drying occurring on the stenter.

In the exemplary execution of bedding product production method 1100, each of the representative samples was configured as a hem and attached to a separate plain body by single needle stitching comprising a minimum 30 count 2 ply 100% polyester disperse-dyed sewing thread. The completed bedding products having the representative samples were then tested to determine performance.

Testing and Results

Each of the bedding products having a representative sample was tested according to testing procedures standardized by the American Association of Textile Colorist and Chemist (AATCC) and the Association of Standard Test Method (ASTM). Specifically, each bedding product having a different colored hem was tested according to gray scale test AATCC 61, test number 5A "Colorfastness to commercial Laundering—Accelerated." Shade change based on AATCC gray scale (i.e., a scale of 1-5, with 5 being no change) was recorded at different intervals corresponding to differing numbers of industrial launderings (IDL). The shade change results for the 5 different colors of the representative samples were:

| | Shade Change after Industrial Launderings with Bleach | | | | | | |
|---|---|---|---|---|---|---|---|
| Color Name | 1 IDL | 5 IDL | 10 IDL | 20 IDL | 30 IDL | 40 IDL | 50 IDL |
| Tan | 4.5 | 4.5 | 4.0 | 4.0 | 3.5 | 3.5 | 3.0 |
| Blue | 4.5 | 4.5 | 4.0 | 4.0 | 3.5 | 3.5 | 3.0 |
| Orange | 4.5 | 4.5 | 4.0 | 4.0 | 3.5 | 3.0 | 3.0 |
| Green | 5.0 | 5.0 | 5.0 | 4.5 | 4.0 | 4.0 | 3.5 |
| Yellow | 4.5 | 4.5 | 4.5 | 4.0 | 3.5 | 3.5 | 3.0 |

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A method of producing a bedding product comprising a plain body and a colored hem, the method comprising:

selecting a hem fabric at least in part based upon a composition of the fabric, the composition of the fabric being selected from the group consisting of cotton-only, blends of cotton and polyester, and blends of cotton and non-cotton material;

selecting a combination of dyes at least in part based upon the composition of the hem fabric, such that if the composition contains cotton fibers, the combination of dyes includes a first subcombination of dyes selected from the group consisting essentially of violanthrones, anthraquinones, anthraquinone carbazoles, and indanthrones, and wherein if the composition contains polyester fibers, the combination of dyes includes a second subcombination of dyes selected from the group consisting essentially of high energy disperse thermofixation dyes;

singeing the hem fabric by exposing the hem fabric to at least one flame so as to singe a face and a back of the hem fabric and thereby reduce a number of fibers extending from the face and the back of the fabric;

desizing the hem fabric by passing the hem fabric through a quench bath comprising a desizing agent to remove a residual amount of a sizing agent remaining on the hem fabric from fabrication of the hem fabric;

bleaching the hem fabric, the bleaching comprising:

(i) washing the hem fabric to remove at least a portion of an amount of residue remaining from the desizing or other preliminary process;

(ii) saturating the hem fabric with an amount of caustic;

(iii) steaming the hem fabric saturated by the amount of caustic in an oxygen free environment for 30 to 45 minutes;

(iv) washing the hem fabric to neutralize at least a portion of the amount of caustic saturated in the hem fabric;

(v) saturating the hem fabric with an amount of peroxide;

(vi) steaming the hem fabric saturated by the amount of peroxide in an oxygen free environment for 30 to 45 minutes; and (vii) washing the hem fabric to remove at least a portion of the amount of peroxide saturated in the hem fabric;

mercerizing the hem fabric, the mercerizing comprising:

(i) impregnating the hem fabric with an amount of sodium hydroxide by passing the hem fabric through a solution heated at approximately 140° F. having a concentration of sodium hydroxide in the 20-24% range and through a set of rollers to force sodium hydroxide into the fabric;

(ii) passing the hem fabric impregnated with the amount of sodium hydroxide over a set of rollers to achieve a first set dwell time;

(iii) stabilizing the hem fabric dimensions by passing the hem fabric through a chain stenter; and (iv) washing the hem fabric to remove at least a portion of the amount of sodium hydroxide impregnated in the hem fabric;

applying the combination of dyes to the hem fabric, by:

(i) Immersing the hem fabric in a dye bath containing the combination of dyes to soak in an amount of the combination of dyes;

(ii) Pressing the hem fabric between rollers as the hem fabric exits the dye bath;

(iii) Passing the hem fabric soaked with the amount of the combination of dyes over a set of rollers to achieve a second set dwell time;

(iv) Drying the hem fabric with infrared dryers to prevent migration of the dyes in the amount of the combination of dyes soaked in the hem fabric;

(v) Thermofixation of the dyes in the second subcombination of dyes if the composition contains polyester fibers, the thermofixation including maintaining the hem fabric in an environment heated between 390° F. to 420° F. for a sufficient third dwell time to allow substantially complete penetration of high energy disperse dyes into the polyester fibers of the hem fabric to prevent ring dyeing and then cooling the hem fabric to lock an amount of disperse dye particles into the polyester fibers of the hem fabric;

(vi) Reducing dyes in the first subcombination of dyes if the composition contains cotton fibers, the reducing including introducing the hem fabric into an alkali solution to reduce the first subcombination of dyes to a soluble state and passing the hem fabric through an oxygen-free environment for a fourth set dwell time to allow penetration of dyes in the first subcombination of dyes into the cotton fibers in the hem fabric, the alkali solution comprising sodium hydro sulphite between 3.0 and 5.0 g/L and sodium hydroxide between 3.6 and 8.8 g/L; and (vii) Oxidizing dyes in the first subcombination of dyes if the composition contains cotton fibers; the oxidizing including washing the hem fabric in peroxide to make the dyes in the first subcombination of dyes insoluble and to substantially remove remaining trace amounts of at least the alkali solution;

purging the hem fabric, the purging comprising passing the hem fabric through a series of at least seven washer boxes in order to remove substantially all unfixed dye from the hem fabric, each washer box capable of exchanging 50 percent to 80 percent of an amount of wash liquor entering the washer box via the hem fabric and each washer box being a wide-width commercial independent continuous high-temperature high-flow double-laced washer box with nip rolls and configurable for counter-flow operability and adjustment of water flow, surfactants, pH, and temperature;

post-stabilizing the hem fabric, the post-stabilizing comprising immersing the hem fabric in a softener bath and passing the hem fabric through a chain stenter to counteract a shrinkage of a width of the hem fabric;

drying the hem fabric;

providing a plain body of a bedding product;

configuring a hem from the hem fabric; and attaching the hem to the plain body.

2. The method of producing a bedding product of claim 1, wherein the bedding product comprises a pillowcase.

3. The method of producing a bedding product of claim 1, wherein the bedding product comprises a sheet.

4. The method of claim 1, wherein an amount of wash liquor in the fabric after purging is at least 99% less than an amount of wash liquor in the fabric before purging.

5. The method of claim 4, wherein an amount of wash liquor in the fabric after purging is at least 99.99872% less than an amount of wash liquor in the fabric before purging.

6. The method of claim 5, wherein the colored hem does not substantially bleed onto the body during 50 industrial washes.

7. The method of claim 6, wherein the colored hem does not substantially fade after 50 industrial washes, exhibiting a maximum shade change of 3.0 AATCC gray scale test AATCC 61, test number 5A "Colorfastness to Commercial Laundering—Accelerated".

8. A method of producing a bedding product comprising a bedding product body and a colored hem, the method comprising:

selecting a hem fabric at least in part based upon composition of the fabric, the composition of the fabric being selected from the group consisting of cotton-only, blends of cotton and polyester, and blends of cotton and non-cotton material;

selecting a combination of dyes at least in part based upon the composition of the fabric, wherein if the composition contains cotton, the combination of dyes includes a first subcombination of dyes, and wherein if the composition contains polyester, the combination of dyes includes a second subcombination of dyes;

preparing the hem fabric by mercerization if the selected fabric contains cotton;

applying the combination of dyes to the selected fabric; and passing the fabric through a multiple stage wash to substantially remove unfixed dyes from the hem fabric; and attaching a hem comprising hem fabric to the bedding product body;

wherein the first subcombination of dyes includes dyes selected from the group consisting essentially of violanthrones, anthraquinones, anthraquinone carbazoles, and indanthrones;

wherein the second subcombination of dyes includes dyes selected from the group consisting essentially of high energy disperse thermofixation dyes;

singeing the hem fabric by exposing the hem fabric to at least one flame so as to singe a face and a back of the hem fabric and thereby reduce a number of fibers extending from the face and the back of the fabric;

desizing the hem fabric by passing the hem fabric through a quench bath comprising a desizing agent to remove a residual amount of a sizing agent remaining on the hem fabric from fabrication of the hem fabric;

bleaching the hem fabric, the bleaching comprising:

(i) washing the hem fabric to remove at least a portion of an amount of residue remaining from the desizing or other preliminary process;

(ii) saturating the hem fabric with an amount of caustic;

(iii) steaming the hem fabric saturated by the amount of caustic in an oxygen free environment for 30 to 45 minutes;

(iv) washing the hem fabric to neutralize at least a portion of the amount of caustic saturated in the hem fabric;

(v) saturating the hem fabric with an amount of peroxide;

(vi) steaming the hem fabric saturated by the amount of peroxide in an oxygen free environment for 30 to 45 minutes; and (vii) washing the hem fabric to remove at least a portion of the amount of peroxide saturated in the hem fabric;

wherein preparing the hem fabric by mercerization if the selected fabric contains cotton comprises:

(i) impregnating the hem fabric with an amount of sodium hydroxide by passing the hem fabric through a solution heated at approximately 140° F. having a concentration of sodium hydroxide in the 20-24% range and through a set of rollers to force sodium hydroxide into the fabric;

(ii) passing the hem fabric impregnated with the amount of sodium hydroxide over a set of rollers to achieve a first set dwell time;

(iii) stabilizing the hem fabric dimensions by passing the hem fabric through a chain stenter; and (iv) washing the hem fabric to remove at least a portion of the amount of sodium hydroxide impregnated in the hem fabric;

wherein applying the combination of dyes to the hem fabric comprises:

(i) Immersing the hem fabric in a dye bath containing the combination of dyes to soak in an amount of the combination of dyes;

(ii) Pressing the hem fabric between rollers as the hem fabric exits the dye bath;

(iii) Passing the hem fabric soaked with the amount of the combination of dyes over a set of rollers to achieve a second set dwell time;

(iv) Drying the hem fabric with infrared dryers to prevent migration of the dyes in the amount of the combination of dyes soaked in the hem fabric;

(v) Thermofixation of the dyes in the second subcombination of dyes if the composition contains polyester fibers, the thermofixation including maintaining the hem fabric in an environment heated between 390° F. to 420° F. for a sufficient third dwell time to allow substantially complete penetration of high energy disperse dyes into the polyester fibers of the hem fabric to prevent ring dyeing and then cooling the hem fabric to lock an amount of disperse dye particles into the polyester fibers of the hem fabric;

(vi) Reducing dyes in the first subcombination of dyes if the composition contains cotton fibers, the reducing including introducing the hem fabric into an alkali solution to reduce the first subcombination of dyes to a soluble state and passing the hem fabric through an oxygen-free environment for a fourth set dwell time to allow penetration of dyes in the first subcombination of dyes into the cotton fibers in the hem fabric, the alkali solution comprising sodium hydro sulphite between 3.0 and 5.0 g/L and sodium hydroxide between 3.6 and 8.8 g/L; and (vii) Oxidizing dyes in the first subcombination of dyes if the composition contains cotton fibers; the oxidizing including washing the hem fabric in peroxide to make the dyes in the first subcombination of dyes insoluble and to substantially remove remaining trace amounts of at least the alkali solution;

wherein passing the fabric through a multiple stage wash to substantially remove unfixed dyes from the hem fabric comprises purging the hem fabric, the purging comprising passing the hem fabric through a series of at least seven washer boxes in order to remove substantially all unfixed dye from the hem fabric, each washer box capable of exchanging 50 percent to 80 percent of an amount of wash liquor entering the washer box via the hem fabric and each washer box being a wide-width commercial independent continuous high-temperature high-flow double-laced washer box with nip rolls and configurable for counter-flow operability and adjustment of water flow, surfactants, pH, and temperature;

post-stabilizing the hem fabric, the post-stabilizing comprising immersing the hem fabric in a softener bath and passing the hem fabric through a chain stenter to counteract a shrinkage of a width of the hem fabric;

drying the hem fabric;

providing a plain body of a bedding product;

configuring a hem from the hem fabric; and wherein attaching a hem comprising hem fabric to the bedding product body comprises attaching the hem to the plain body.

9. The method of claim 8, wherein an amount of wash liquor in the fabric after purging is at least 99% less than an amount of wash liquor in the fabric before purging.

10. The method of claim 8, wherein an amount of wash liquor in the fabric after purging is at least 99.99872% less than an amount of wash liquor in the fabric before purging.

11. The method of claim 8, wherein the colored hem does not substantially bleed onto the body during 50 industrial washes.

12. The method of claim 8, wherein the colored hem does not substantially fade after 50 industrial washes, exhibiting a maximum shade change of 3.0 AATCC gray scale test AATCC 61, test number 5A "Colorfastness to Commercial Laundering—Accelerated".

* * * * *